US006241243B1

(12) United States Patent
Ishida et al.

(10) Patent No.: US 6,241,243 B1
(45) **Date of Patent: *Jun. 5, 2001**

(54) METHOD OF AND APPARATUS FOR DETECTING ABNORMAL PAPER FEEDING

(75) Inventors: Masaaki Ishida; Yoshiro Hatakeyama, both of Toride (JP)

(73) Assignee: Komori Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,190

(22) Filed: Nov. 12, 1998

(30) Foreign Application Priority Data

Nov. 13, 1997 (JP) ..... 9-311779

(51) Int. Cl.[7] ..... B65H 7/02
(52) U.S. Cl. ..... 271/258.01; 271/259; 271/265.01
(58) Field of Search ..... 271/258.01, 259, 271/265.01

(56) References Cited

U.S. PATENT DOCUMENTS

| | | | | |
|---|---|---|---|---|
| 3,970,384 | * | 7/1976 | Yamamoto et al. | 399/21 |
| 4,159,109 | * | 6/1979 | Watson et al. | 271/259 |
| 4,203,589 | * | 5/1980 | Arrasmith | 271/258.01 |
| 4,310,153 | * | 1/1982 | Kikuchi | 271/259 |
| 5,280,322 | * | 1/1994 | Kono | 399/22 |
| 5,544,580 | * | 8/1996 | Takahashi | 101/118 |
| 5,580,046 | * | 12/1996 | Beaufort et al. . | |
| 5,983,796 | * | 11/1999 | Ishida et al. | 101/232 |

FOREIGN PATENT DOCUMENTS

| | | |
|---|---|---|
| 0480316 | 4/1992 | (EP) . |
| 2071064 | 9/1981 | (GB) . |
| 239808 | 10/1990 | (JP) . |
| 239808Y2 | 10/1990 | (JP) . |

OTHER PUBLICATIONS

Patent Abstracts of Japan, vol. 017, No. 155 (M–1388), Mar. 16, 1993—Abstract for JP 04–323044A, published Nov. 12, 1992.

Patent Abstracts of Japan, vol. 017, No. 155 (M–1388), Mar. 16, 1993 –Abstract for JP 04–323044A, published Nov. 12, 1992.

* cited by examiner

*Primary Examiner*—Donald P. Walsh
*Assistant Examiner*—David A. Jones
(74) *Attorney, Agent, or Firm*—Birch, Stewart, Kolasch & Birch, LLP

(57) ABSTRACT

A method and apparatus for detecting an abnormal paper feed such as a paper jam in a printing press which can reduce the work load for an operator and prevent productivity and printing quality from being lowered by detecting the elapsed time of travel of a first sheet of paper from a paper feeder to a register, with the time corresponding to the number of sheets reaching the register. This number is compared to a number of paper sheets stored in a memory. When there is an agreement between the compared sheet numbers, normal paper feeding is indicated. When the detected number of sheets is more or less than the number stored in memory, abnormal paper feeding is indicated and further paper feeding is interrupted. A number less than the required number is indicative of paper remaining on a feeder board from a previous printing operation. A number larger than the required number is indicative of a paper jam.

4 Claims, 5 Drawing Sheets

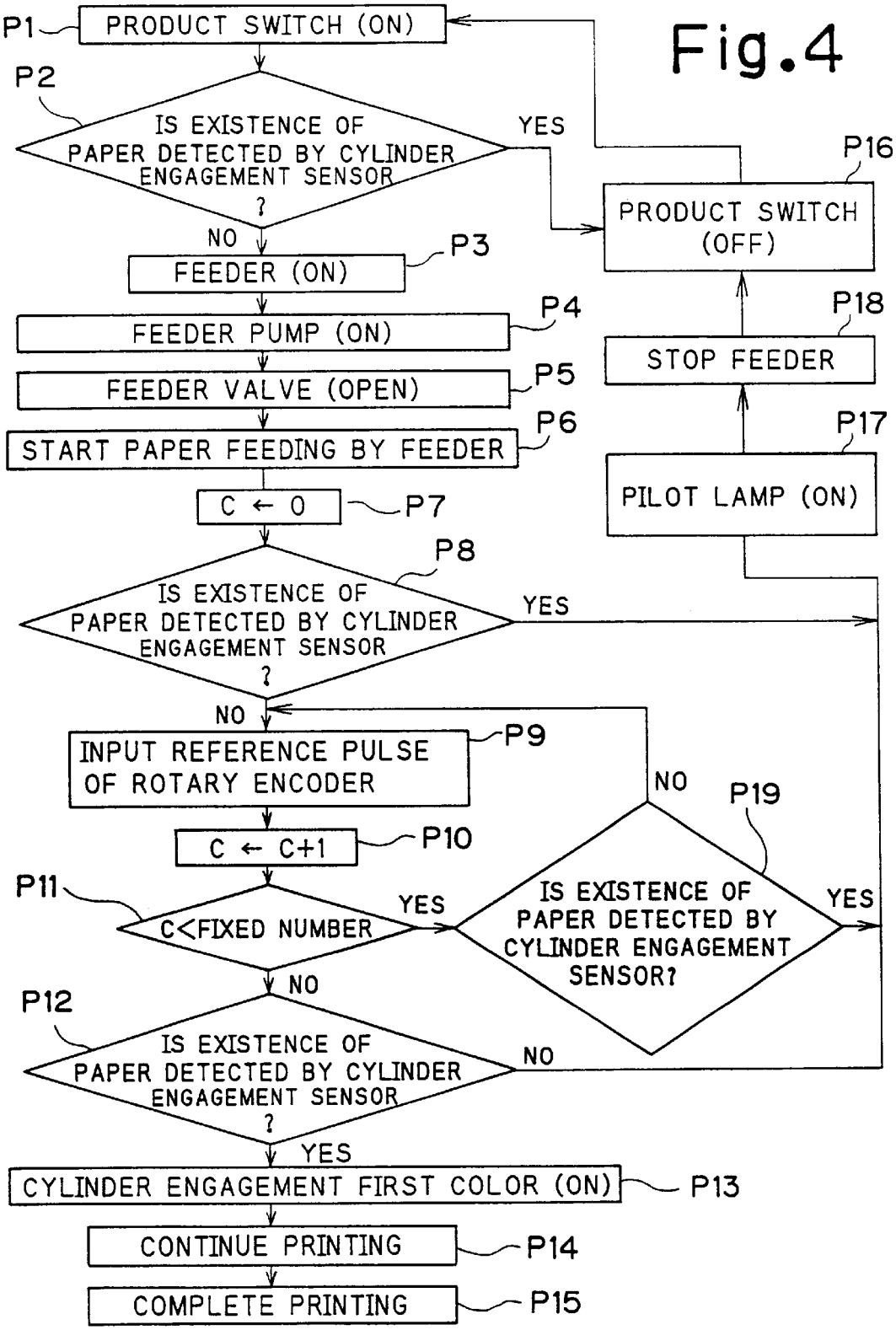
Fig.4
P1
PRODUCT SWITCH (ON)
P2
IS EXISTENCE OF PAPER DETECTED BY CYLINDER ENGAGEMENT SENSOR ?
YES
NO
P3
FEEDER (ON)
P4
FEEDER PUMP (ON)
P5
FEEDER VALVE (OPEN)
P6
START PAPER FEEDING BY FEEDER
C ← 0
P7
P8
IS EXISTENCE OF PAPER DETECTED BY CYLINDER ENGAGEMENT SENSOR ?
YES
NO
P9
INPUT REFERENCE PULSE OF ROTARY ENCODER
C ← C+1
P10
P11
C<FIXED NUMBER
YES
NO
P19
IS EXISTENCE OF PAPER DETECTED BY CYLINDER ENGAGEMENT SENSOR?
YES
NO
P12
IS EXISTENCE OF PAPER DETECTED BY CYLINDER ENGAGEMENT SENSOR ?
NO
YES
CYLINDER ENGAGEMENT FIRST COLOR (ON)
P13
CONTINUE PRINTING
P14
COMPLETE PRINTING
P15
P16
PRODUCT SWITCH (OFF)
P18
STOP FEEDER
P17
PILOT LAMP (ON)

METHOD OF AND APPARATUS FOR DETECTING ABNORMAL PAPER FEEDING

BACKGROUND OF THE INVENTION

1. Field of the Invention

The present invention relates to a method and apparatus, acting as a safety device, for detecting abnormal paper feeding in a sheet printer and, more particulary, for detecting abnormal paper feeding in a sheet printer from a paper feeding portion to a printing unit portion thereof.

2. Description of the Prior Art

When performing a printing operation on a rotary printing press such as shown and described in assignee's U.S. Pat. No. 5,983,796, Ishida et al., Nov. 16, 1999, an operator operates the apparatus to feed printing papers piled on a paper feeding portion to a printing unit portion to start the printing operation. However, there are times when paper feeding is not performed normally due to "an improper setting of the paper feeding portion in various kinds of apparatuses" or "problems with the papers" or the like occurs. In response to such abnormal paper feeding, various kinds of safety apparatuses are provided in a paper register portion or the paper feeding portion itself so as to automatically detect this malfunction.

For example, as disclosed in Japanese Utility Model Publication No. 2-39808, there is shown apparatus for detecting abnormal paper feeding having a luminescent element and a photoreceptor element provided near a front lay in a feeder board of the sheet printer for detecting whether an abnormal paper feeding state with respect to the front lay of a sheet paper is large or small. The apparatus includes a control circuit which transmits a cylinder disengagement signal in synchronism with an operation of the printer and a control signal for discharging sheet paper as a special state when the abnormal paper feeding state is large on the basis of a detected output from the photoreceptor element, and transmits only the control signal in synchronism with an operation of the printer when the abnormal paper feeding state is small. In accordance with the foregoing apparatus, there is an advantage if the number of interruptions of operation can be reduced and the sheet paper, in a small abnormal paper feeding state, can be discharged as the special state after being printed so as to be easily separated from a normal sheet paper.

However, conventional safety apparatus including the apparatus mentioned above performs a function as a safety device by directly detecting "a positional shift of paper" or "overlapping papers" or the like. Accordingly, the following problems can occur during a printing operation.

(1) In the situation where paper does not reach a plurality of safety devices provided in the register portion even when a timing for feeding a paper is shifted, an accurate detection and judgement as to whether the paper feeding state can or not can not performed.

(2) Generally, since the safety device performs the foregoing detection at a fixed timing (within a time period),there is a case where the detection of the abnormal paper is delayed when the timing of the fed paper is shifted, and the safety apparatus cannot perform the function as the safety device.

(3) There are times when the fed paper is interrupted by the register portion or a member provided on the feeder board, resulting in too many papers flowing into the printing unit portion, and causing damage or trouble in the apparatus or a blanket or the like.

(4) When a malfunction mentioned above is generated, it is necessary for the operator to always observe whether or not the paper fed from the paper feeding portion properly enters the register portion.

(5) When a malfunction mentioned above is generated, not only is some damage caused, but also a loss time for a post operation is generated therewith, so that not only are productivity and printing quality reduced, but also the work load for the operator is increased.

SUMMARY OF THE INVENTION

Accordingly, an object of the present invention is to provide a method and apparatus for detecting an abnormal paper feed which can increase the work load on an operator and lessen productivity and printing quality by improving a detecting function with respect to a timing shift of fed paper to avoid various kinds of malfunctions previously caused by abnormal paper feeding.

In order to achieve the object mentioned above and in accordance with the present invention, there is provided a method of detecting an abnormal paper feed comprising the steps of detecting the number of papers fed to a printer based on a paper feeding signal generator generating a signal in response to paper feeding after the start of paper feeding, detecting whether or not paper exists on a feeder board by a paper existence detector located on the feeder board, and detecting an abnormal paper feed state in accordance with a relation between the number of the papers fed and the existence or non-existence of detected paper.

In the method of detecting abnormal paper feeding according to the above, an abnormal paper feed is judged to exist in the case where said paper existence detector does not detect the existence of paper on the feeder board when said number of the fed papers is equal to a preset fixed number.

In the method of detecting an abnormal paper feeding according to the above, an abnormal paper feeding is judged to exist in the case when said paper existence detector detects the existence of paper when said number of the fed papers is less than a preset fixed number.

Further, in accordance with the present invention, there is provided an apparatus for detecting abnormal paper feed, which is used for the method of detecting an abnormal paper feed according to the above comprising, a paper feeding start signal generator, a paper feeding signal generator generating a signal in response to paper fed to a printer, a paper existence detector located on a feeder board, and a control apparatus having number of fed paper memory means for storing a number of papers fed to the printer until a first paper comes to the paper existence detector after the paper feed is started, and detecting an abnormal paper feed from a relation among the number of fed papers from said paper feeding signal generator, the number of the fed papers stored in said number of fed paper memory means and the detected signal of said paper existence detector so as to output a paper feed stop signal.

In the apparatus for detecting an abnormal paper feed according to the above, the control apparatus outputs a paper feeding stop signal by judging an abnormal paper feeding in the case when the paper existence detector does not detect the existence of paper when the number of the fed paper for the printer, after the paper feeding is started, equals to the number of the fed paper stored in said number of fed paper memory means.

In the apparatus for detecting an abnormal paper feed according to the above, the control apparatus outputs a paper feeding stop signal by judging abnormal paper feed in the case that the paper existence detector detects the paper existence when the number of the fed paper for the printer, after the paper feeding is started, is less than the number of the fed paper stored in said number of fed paper memory means.

In accordance with the method of and the apparatus for detecting abnormal paper feed mentioned above, an abnormal paper feed due to a timing shift from the paper feeding portion to the register portion can be automatically and accurately detected, so that a paper feed to the printing unit thereafter can be securely stopped.

BRIEF DESCRIPTION OF THE DRAWINGS

FIG. 4 is a flow chart of an operation of a control apparatus which comprises an embodiment in accordance with the present invention.

DESCRIPTION OF THE PREFERRED EMBODIMENT

Figure 1:
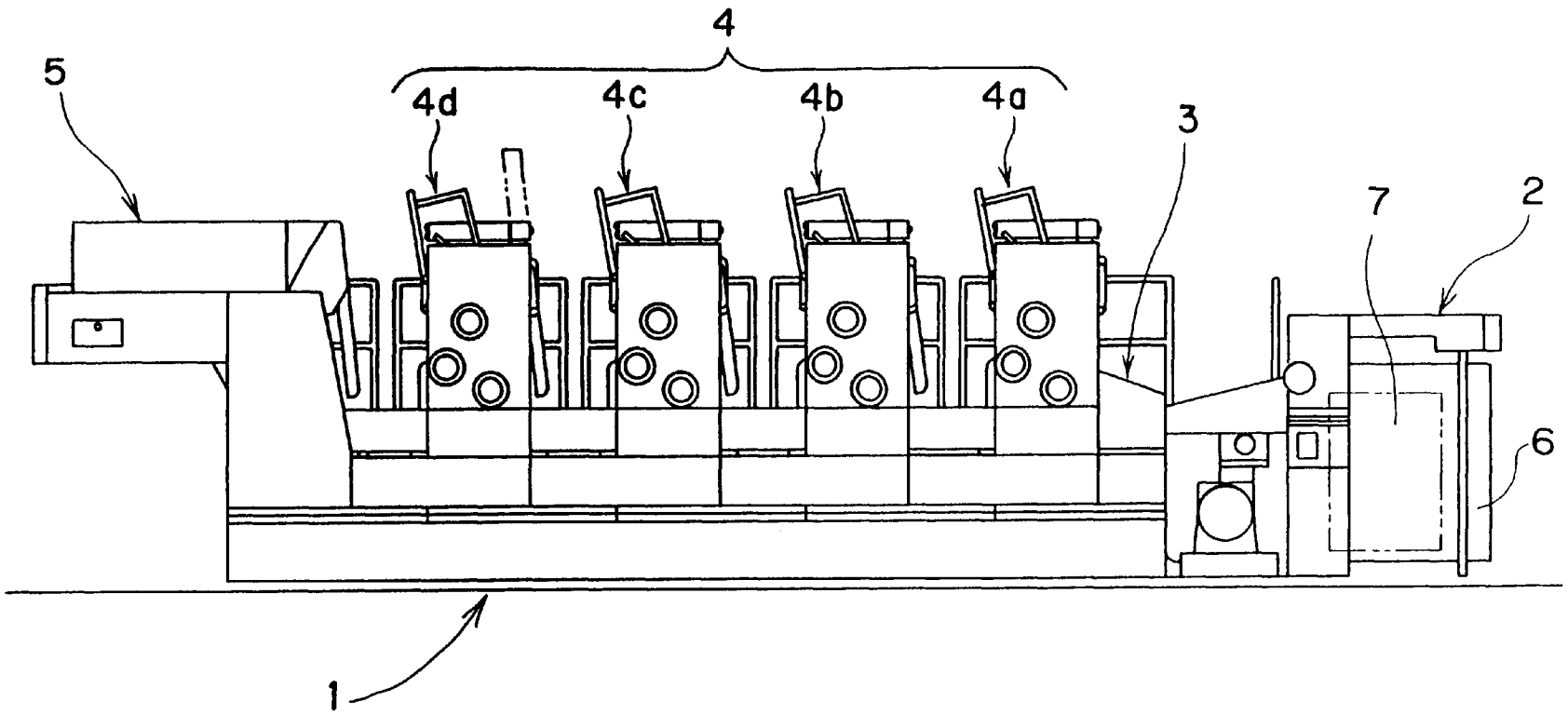
FIG. 1 is a complete side elevational view of a four color printing sheet paper rotary printer which shows an embodiment in accordance with the present invention.
Figure 2:
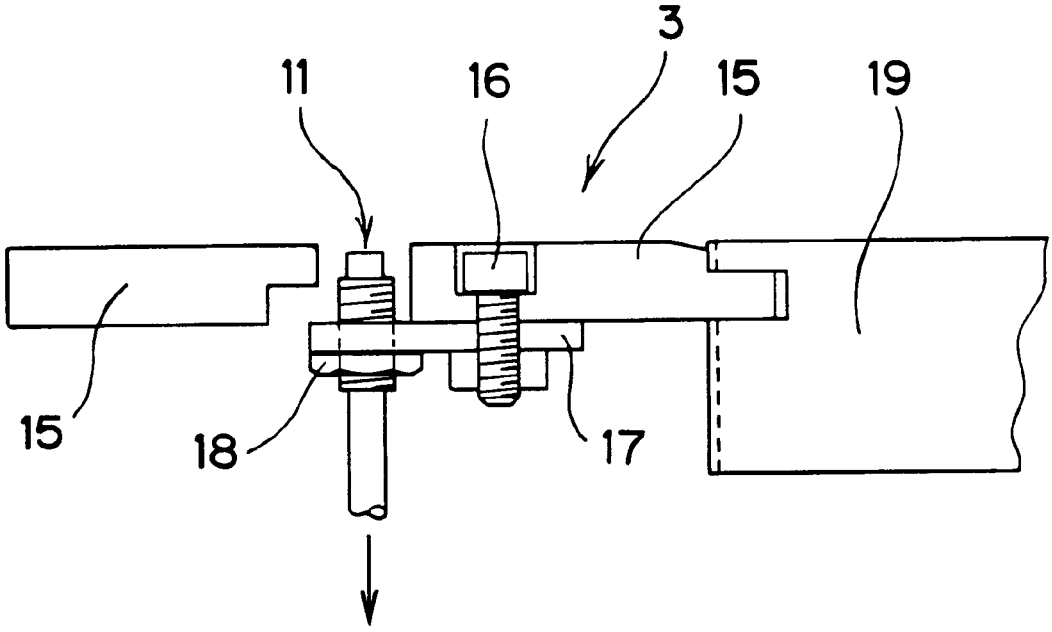
FIG. 2 is a detailed view of a main portion of a register portion which shows an embodiment in accordance with the present invention.
Figure 5:
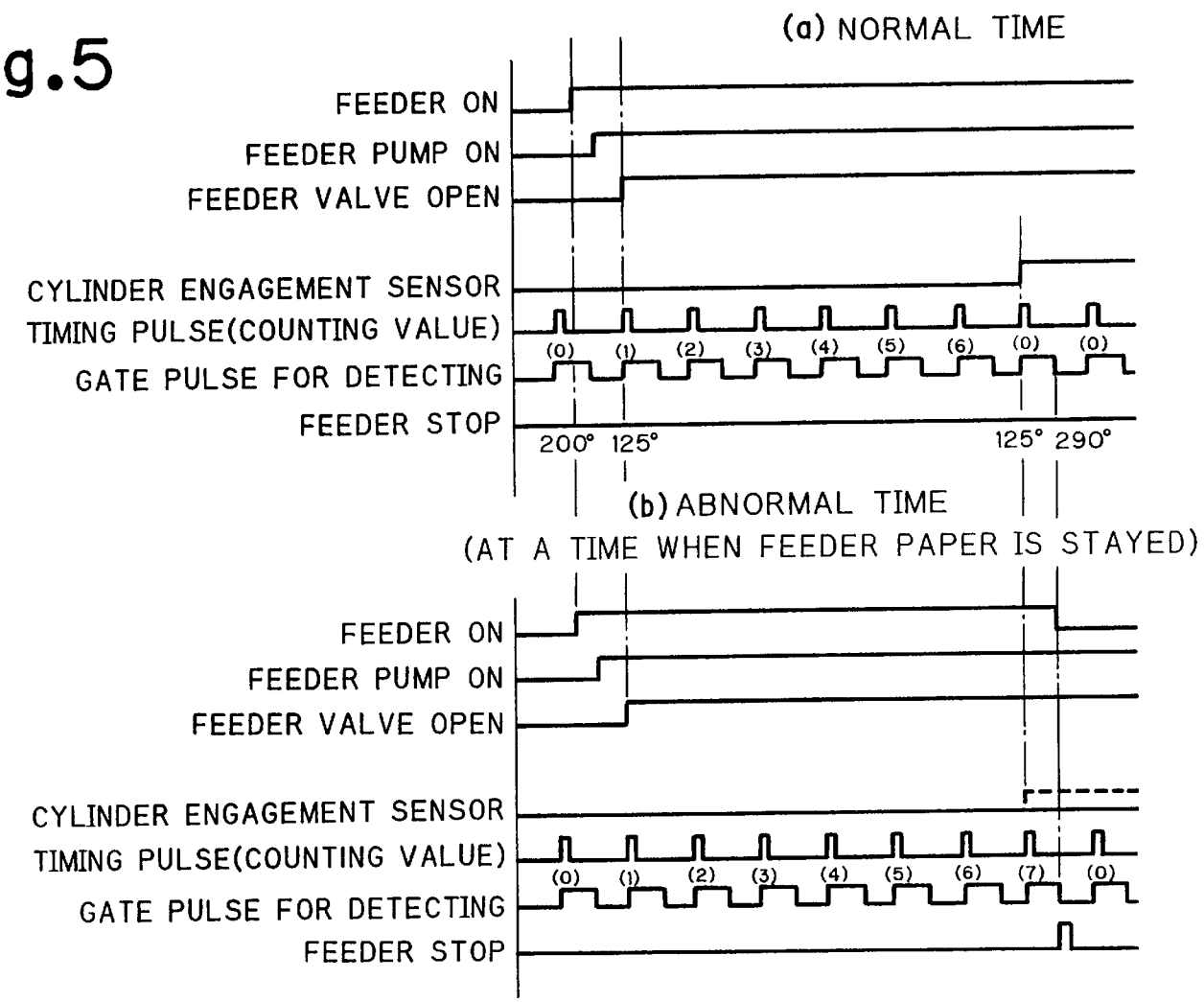
FIG. 5 is a timing chart at a normal time and an abnormal time of the control apparatus which shows an embodiment in accordance with the present invention.

A method and apparatus for detecting an abnormal paper feed in accordance with the present invention will be described in detail on the basis of an embodiment shown in the accompanying drawings and where:

FIG. 1 is a side elevational view of a four color printing sheet paper rotary printer depicting an embodiment of the present invention; FIG. 2 is a detailed view of a main portion of a register portion; FIG, 3 is a plan view of a control panel; FIG. 4 is a flow chart of the operation of the control apparatus of the present invention; and FIG. 5 is a timing chart illustrative of a normal time and an abnormal time of apparatus of the control apparatus.

As shown in FIG. 1, a four color printing sheet paper rotary printer 1 is structured such that it includes a paper feeding portion 2, a register portion 3, a printing unit portion 4, and a paper discharging portion 5 and which are successively arranged in the order from the right and where a pile of sheet paper 6 placed on the paper feeding portion 2 is printed and discharged to the paper discharging portion 5 after being successively fed to a first to fourth color printing units 4*a* to 4*d* through the register portion 3.

Any changes in the paper feed time of the sheet paper 6 fed from the paper feeding portion 2 to the register portion 3 is automatically detected by a control apparatus (a control circuit), not shown located within a control table 7 mounted on a side surface of the paper feeding portion 2, whereupon paper feeding to the printing unit portion 4 is thereafter stopped.

Accordingly, in the above control apparatus, the following signals are input: signals such as an ON signal from a product switch 10 (described below), provided by a paper feed start signal generator; a reference pulse of a rotary encoder, provided by a paper feed signal generator which generates a signal in accordance with a paper feed in the four color printing sheet paper rotary printer 1; and a paper existence/non-existence signal from a cylinder engagement sensor 11 (described later), generated by a paper existence/non-existence detector. The control apparatus also includes a paper feed number memory means which stores a number of fed paper sheets in the four color printing sheet paper rotary printer 1, to which the first sheet of paper from the pile 6 is supposed to be delivered to and thus passes over the cylinder engagement sensor 11 following the beginning of paper feed. When the cylinder engagement sensor 11 does not output a paper existence signal at the time when the number of paper feed, from the beginning of the paper feed, is equal to the number stored in the paper feed number memory means, or when the cylinder engagement sensor 11 outputs the paper existence signal at the time when the number of paper feed, from the beginning of the paper feed, is less than the number stored in the paper feed number memory means, the control apparatus determines that an abnormal paper feed has occurred, illuminates a pilot lamp 12 (described later), and turns the product switch 10 OFF.

Figure 3:
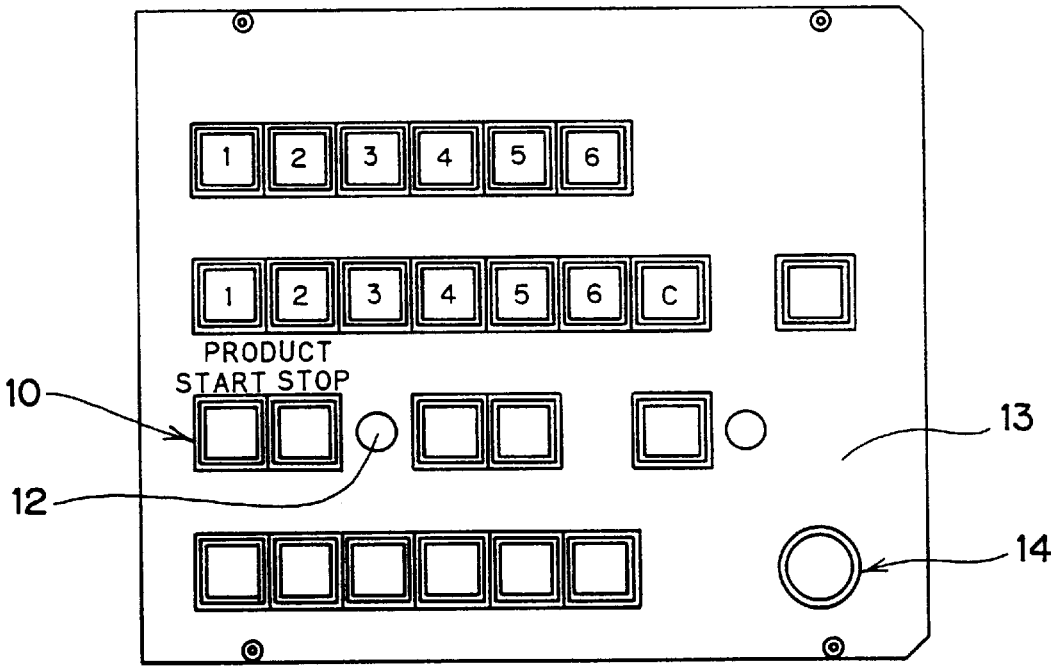
FIG. 3 is a plan view of an operational panel which shows an embodiment in accordance with the present invention.

The product switch 10 mentioned above is disposed on an operation control panel 13 provided in the paper discharging portion 5, as shown in FIG. 3, and outputs the ON signal, a signal for starting a paper feed by pushing a start button by the operator. Further, the pilot lamp 12 and a printer stop button 14 are provided on the operation control panel 13.

The cylinder engagement sensor 11 is fixed to a feeder board 15, provided in the register portion 3, by a fixing screw 16, as shown in FIG. 2, and is structured to detect whether or not the paper exists by a quantity of a reflected ray. Further, the cylinder engagement sensor 11 is threaded to a holder 17, and is structured such that a height of a detecting surface can be adjusted by a nut 18. Element 19 comprises an intermediate element located between the feeder board 15 and a convey board, not shown.

Further, the rotary encoder is provided on a rotary shaft in a drive system of the four color printing sheet paper rotary printer 1, and generates a pulse signal for each rotation of the shaft.

Being structured in the above manner, a printing operation can be started by the operator performing a drive operation of the four color printing sheet paper rotary printer 1 by turning on the product switch 10. When the printing operation is started, the paper sheets 6 piled on the paper feeding portion 2 are automatically fed to the register portion 3 from the paper feeding portion 2, and are conveyed to the paper discharging portion 5 and piled there after being printed in each of the printing units 4*a* to 4*d*.

Normally, the printing operation is performed in accordance with the procedure mentioned above. However, due to various reasons, there is an instance where the feed timing for the sheet paper 6 shifts from the normal paper feed timing at a time of starting the feeding of the paper sheet 6. In such an instance, in this embodiment, the control apparatus in the control table 7, mentioned above, detects this, thereby turning on the pilot lamp 12 on the operation panel 13, outputting a paper feeding stop signal, and turning off the product switch 10.

A control operation of the control apparatus will now be described below on the basis of the operation flow chart shown in FIG. 4 with reference to the timing chart in FIG. 5.

At first, when the product switch 10 is turned on by the operator in step P1, whether or not sheet paper 6 exists is detected by the cylinder engagement sensor 11 in step P2. When the sheet paper 6 printed at the preceding time is left on the feeder board 15, the product switch 10 is turned off in step P16. That is, the control is maintained until the remaining paper is removed.

When the remaining paper no longer exists on the feeder board 15 in step P2, the controls such as "turning on a feeder", "turning of a feeder pump", "opening a feeder valve" and the like are continuously and automatically performed in steps P3 to P5.

Next, after paper feeding in the feeder is started in step P6 and a counter is reset to zero in step P7, whether or not sheet paper 6 exists is again detected by the cylinder engagement sensor 11 in step P8, and when the sheet paper 6 printed in the preceding time remains on the feeder board 15, the pilot lamp 12 is turned on in step P17, the feeder is stopped in step P18 and, successively, the product switch 10 is turned off in step P16.

When the remaining paper does not exist on the feeder board 15 in step P8, a reference pulse of the rotary encoder is input in step P9, and the counter starts a counting operation of the reference pulse in step P10. That is, the number of the fed paper for the four color printing sheet paper rotary printer 1 from the beginning of the paper feeding until the first sheet paper 6 comes to the cylinder engagement sensor 11 is calculated by the reference pulse of the rotary encoder mentioned above.

Next, an actual number of the fed paper is compared with a predetermined fed paper number (for example seven), previously stored in the number of fed paper memory means in step P11. In the case where the cylinder engagement sensor 11 outputs a paper existence signal when the number of the fed paper is less than the number of the fed paper stored in the number of fed paper memory means, it signifies that abnormal paper feeding, caused by the paper feeding timing being shifted to an early side, is judged in step P19, the pilot lamp 12 is turned on in step P17, the feeder is stopped (turned off) in step P18, and the product switch 10 is successively turned off in step P16.

In the case where the cylinder engagement sensor 11 does not output a paper existence signed in step P19, it signifies that normal paper feeding is being performed, so that the step is returned to step P9 and the counting is continued.

Next, in the case when it is determined, in step 11, that the cylinder engagement sensor 11 does not output a paper existence signal when the actual number of the fed paper and the predetermined number of the fed paper, previously stored in the fed paper memory means, are equal, it is determined that an abnormal paper feeding caused by the paper feed timing being shifted to a delay side, so that the pilot lamp 12 is turned on in step P17, the feeder is stopped (turned off) in step P18, and the product switch 10 is successively turned off in step P16.

In reality, as shown in FIG. 5B, since the paper existence signal from the cylinder engagement sensor 11 is not output therefrom during the seventh detecting gate pulse, a feeder stop signal is output. In this case the detecting gate pulse is output during a fixed rotary angle of the printer with reference to the reference pulse (the timing pulse) from the rotary encoder.

In the case where the cylinder engagement sensor 11 outputs a paper existence signal in step P12, normal paper feeding is being performed. Therefore, a cylinder engagement signal of the printing unit 4*a* for a first color is output in step P13. Thereafter, a printing operation in each of the printing units 4*b* to 4*d* for a second color to a fourth color is continued in step P14, and a printing is complete in step P15. In this case, the pilot lamp 12 illuminated in step P17 is automatically turned off when "the feeder is again turned on" after taking necessary steps for the sheet paper that has been abnormally fed.

As mentioned above, in the present embodiment, the steps necessary due to the timing shift of the paper feeding can be omitted. Accordingly, a typical watch operation for preventing a malfunction from occurring can be omitted. As a result, the work load of the operator can be reduced and the time can be reduced, so that a productivity can be improved and a printing quality can be stabilized. Further, since the conventional cylinder engagement sensor 11 and rotary encoder can be used, it is advantageous in cost.

In the embodiment mentioned above, the reference pulse of the rotary encoder is used as means for detecting the number of paper sheets 6 fed to the register portion 3 from the paper feeding portion 2. However, a sensor can be provided in a part of a sucker main body such that the number of the papers is counted at a position at which the sheet paper 6 is sucked by a first suction port so as to be lifted up, or a sensor for detecting a pressure change can be provided within a passage of a pipe of a sucker valve such that the number of the papers is counted by detecting the pressure change in a state that the sheet paper is sucked.

Further, the present invention is not limited to the embodiment mentioned above, and it is needless to say that various kinds of modifications can be made within the scope of the invention.

As mentioned above, in accordance with the method and apparatus for detecting abnormal paper feed of the present invention, the control apparatus is provided with a signal from a paper feed start signal generator. A signal from a paper feed signal generator which generates a signal in accordance with a paper feed in the printer, and a paper existence/non-existence signal from paper existence/non-existence detector provided on the feeder board. Further, the control apparatus has a paper feed number memory means which stores a predetermined number of fed paper in the printer, to which the first paper sheet is supposed to be delivered to the paper existence/non-existence detector. When the paper existence/non-existence detector does not output a paper existence signal at the time when the number of paper feed, from the beginning of the paper feed, is equal to the number the predetermined number stored in the memory means, or when the paper existence signal at the time when the number of paper feed, from the beginning of the paper feed, is less than the predetermined number stored the memory means, the control apparatus determines that an abnormal paper feed has occurred, and generates a paper feed stop signal. Therefore, abnormal paper feed between the paper feed portion and the register portion due to the shift in the timing can be automatically detected with high accuracy, thus preventing various malfunctions due to abnormal paper feed. This reduces the workload of an operator and prevents reduction in manufacturing efficiency and printing quality.

What is claimed is:

1. A method of detecting abnormal paper feeding during a printing operation, comprising the steps of:

detecting the number of papers fed to a printer by a paper feeding signal generator generating a signal in response to paper feeding after a start of a paper feeding operation;

detecting whether or not a paper exists on a feeder board by a paper existence detector located thereon; and detecting abnormal paper feeding in accordance with a relation between said number of the papers fed and existence or non-existence of said paper on the feeder board, and wherein said abnormal paper feeding is judged when said number of the fed papers detected by said paper existence detector is less than a preset fixed number.

2. A method of detecting abnormal paper feeding as claimed in claim 1, wherein abnormal paper feeding is judged where said paper existence detector does not detect the existence of paper when said number of the fed papers is equal to said preset fixed number.

3. An apparatus for detecting an abnormal paper feeding comprising:

a paper feeding start signal generator; a paper feeding signal generator generating a signal in response to paper being fed to a printer;

a paper existence detector located on a feeder board; and a control apparatus including a number of fed paper memory means for storing a number of fed papers for the printer until a first paper comes to the paper existence detector after the paper feeding is started, and detecting an abnormal paper feeding from a relation between the number of fed papers from said paper feeding signal generator, the number of the fed papers stored in said number of fed paper memory means and the detected signal of said paper existence detector so as to output a paper feeding stop signal;

wherein said control apparatus outputs the paper feeding stop signal by judging an abnormal paper feed where the paper existence detector detects the existence of paper on the feeder board when the detected number of the fed paper to the printer after the paper feeding is started is less than the number of the fed paper stored in said number of fed paper memory means.

4. An apparatus for detecting an abnormal paper feeding as claimed in claim 3, wherein said control apparatus outputs a paper feeding stop signal by judging an abnormal paper feeding where the paper existence detector does not detect the paper existence on the feeder board when the number of the fed paper for the printer after the paper feeding is started equals to the number of the fed paper stored in said number of fed paper memory means.

* * * * *